US012187510B2

(12) United States Patent
Panajchariya

(10) Patent No.: US 12,187,510 B2
(45) Date of Patent: Jan. 7, 2025

(54) MASON JAR LID

(71) Applicant: Pakorn Panajchariya, Downers Grove, IL (US)

(72) Inventor: Pakorn Panajchariya, Downers Grove, IL (US)

( * ) Notice: Subject to any disclaimer, the term of this patent is extended or adjusted under 35 U.S.C. 154(b) by 437 days.

(21) Appl. No.: 17/346,210

(22) Filed: Jun. 12, 2021

(65) Prior Publication Data

US 2022/0396402 A1 Dec. 15, 2022

(51) Int. Cl.
*B65D 51/24* (2006.01)
*B65D 51/14* (2006.01)

(52) U.S. Cl.
CPC ..... *B65D 51/245* (2013.01); *B65D 51/145* (2013.01)

(58) Field of Classification Search
CPC .... B65D 51/245; B65D 51/145; B65D 51/18; B65D 51/247; B65D 41/62; B65D 51/1605; B65D 71/0003; B65D 81/3837; B65D 1/10
See application file for complete search history.

(56) References Cited

U.S. PATENT DOCUMENTS 660,435 A * 10/1900 Loper ..... B65D 51/1688 215/307
1,329,248 A * 1/1920 Larkin ..... B65D 39/08 215/307
2,436,291 A * 2/1948 Daniel ..... B65D 51/24 401/122
3,143,235 A * 8/1964 Lowen ..... B65D 41/0435 215/276
3,237,802 A * 3/1966 Wagner ..... B65D 39/08 206/508
3,339,772 A * 9/1967 Miller ..... B65D 47/06 215/277
3,924,772 A * 12/1975 Magnani ..... B65D 51/145 215/354
4,121,525 A * 10/1978 Courtis ..... A01G 7/00 215/261
4,121,729 A * 10/1978 Husum ..... B65D 51/145 215/276
4,347,804 A * 9/1982 Villa-Real ..... A61J 7/04 206/459.1

(Continued)

FOREIGN PATENT DOCUMENTS

DE 3422969 A1 * 1/1986

*Primary Examiner* — Kareen K Thomas
(74) *Attorney, Agent, or Firm* — Daniel S. Bretzius; Dan B Law PLLC

(57) ABSTRACT

A two-piece mason jar lid is described, with said mason jar lid capable of being secured to a mason jar in the typical manner using a threaded band or ring. The two-piece mason jar lid includes an annular lid component and a circular lid component that can be rotatably disposed within the annular lid component. Indicia and indicators disposed on the annular lid component and circular lid component work in cooperation, such that rotation of the circular lid component causes the indicator to be aligned with the desired indicia, to, for example, indicate a date upon which fermentation within the mason jar may be complete. The annular lid component or circular lid component can also include one or more venting channels to permit venting of fermentation gases, while preventing air from entering the mason jar.

2 Claims, 9 Drawing Sheets

(56) References Cited

U.S. PATENT DOCUMENTS 4,871,077 A * 10/1989 Ogden ..... B65D 39/0076 220/254.1
5,251,776 A * 10/1993 Morgan, Jr. ..... F16J 13/065 220/360
5,335,801 A * 8/1994 Lee ..... B65D 51/002 220/366.1
5,348,184 A * 9/1994 Adams ..... B65D 39/0076 220/276
5,598,939 A * 2/1997 Watson ..... A61J 1/2096 215/277
5,711,876 A * 1/1998 Lee ..... B05C 11/1047 210/450
5,799,813 A * 9/1998 Letica ..... B65D 17/506 220/255
6,041,982 A * 3/2000 Cautereels ..... B65D 51/1688 220/366.1
6,202,717 B1 * 3/2001 Markey ..... B67D 7/0294 251/149.6
6,499,618 B1 * 12/2002 Leclerc ..... B65D 39/00 215/307
8,336,728 B2 * 12/2012 Forrest ..... B65D 17/506 220/366.1
8,844,761 B2 * 9/2014 Zabaleta ..... B65D 17/401 220/267
9,637,269 B1 * 5/2017 Zabaleta ..... B65D 17/4014
10,793,326 B2 * 10/2020 Migas ..... B65D 53/04
2003/0127421 A1 * 7/2003 Ziegler ..... B65D 41/045 215/349
2005/0044814 A1 * 3/2005 Patterson ..... B65B 31/06 53/374.9
2005/0189354 A1 * 9/2005 Heather ..... B65D 51/145 215/276
2006/0070998 A1 * 4/2006 Yang ..... B65D 75/5877 220/259.2
2007/0187352 A1 * 8/2007 Kras ..... B65D 51/18 215/276
2008/0073310 A1 * 3/2008 Horton ..... B65D 51/145 215/276
2008/0245789 A1 * 10/2008 Hudecki ..... B65D 21/083 220/729
2009/0294446 A1 * 12/2009 DeJulio ..... B65F 1/1607 220/495.11
2012/0031905 A1 * 2/2012 Perez ..... B65D 81/245 53/471
2014/0072669 A1 * 3/2014 Brown, III ..... B65D 51/145 222/545
2015/0313799 A1 * 11/2015 Alfayyad ..... A61J 7/04 215/230
2015/0360832 A1 * 12/2015 Washeleski ..... B65D 51/145 215/270
2016/0031616 A1 * 2/2016 Rye ..... B65D 51/1616 220/303
2018/0105334 A1 * 4/2018 Carver ..... B65D 51/2821
2018/0360245 A1 * 12/2018 Belmar ..... B65D 47/142
2020/0047957 A1 * 2/2020 Bottger ..... B65D 51/145
2020/0062468 A1 * 2/2020 Deslauriers ..... A23L 3/0155

* cited by examiner

MASON JAR LID

FIELD OF DISCLOSURE

The present disclosure relates to apparatus used to seal mason jars to facilitate fermentation processes.

BACKGROUND

For more than 150 years, Mason jars have been used to preserve food. Over this time period, mason jar lids remained essentially unchanged—mason jars were secured by a unitary planar lid secured to the jar by an outer threaded ring.

In recent years, Mason jars have seen a resurgence and have been used and repurposed in many different ways. This renewed interest has also caused individuals to reconsider how Mason jars can be used for their original and related purposes—to prepare, store, and preserve food. Consumers' interest in mason jars and lid options continues to soar. Several new lid options have become available to facilitate interesting uses, but none provide the most efficient and convenient user experience possible.

SUMMARY

Improvements to the typical unitary planar lid are desirable to permit fermentation and to provide optimal user experiences. This disclosure describes improvements to and variations from the unitary planar lid that can be used to facilitate fermentation and/or better user experience.

The present disclosure describes a two-piece jar lid having an annular component and a circular component. The circular component can be disposed within the annular component and can be rotated to allow an indicator on the circular component to align with indicia on the annular component. Venting channels may also be present in at least one of the components of the jar lid, to permit fermentation gases to vent. Other embodiments are described herein.

BRIEF DESCRIPTION OF THE DRAWINGS

The disclosure below is made with reference to the drawings, in which.

DETAILED DESCRIPTION

Figure 1:
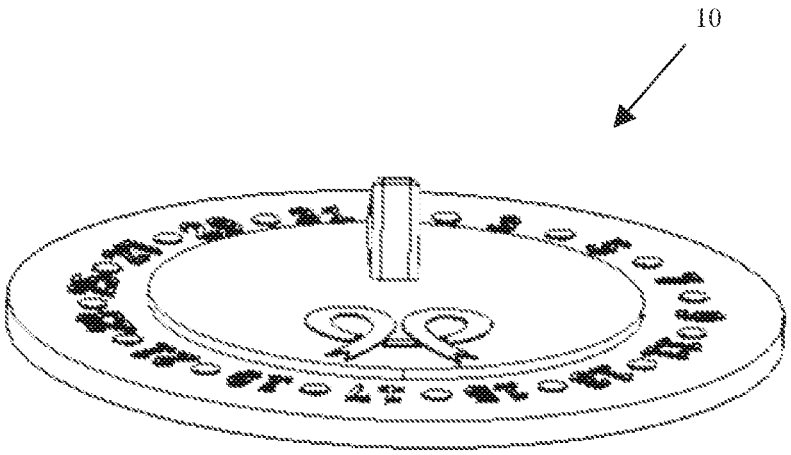
FIG. 1 is a top perspective view of an embodiment of a jar lid.
Figure 2:
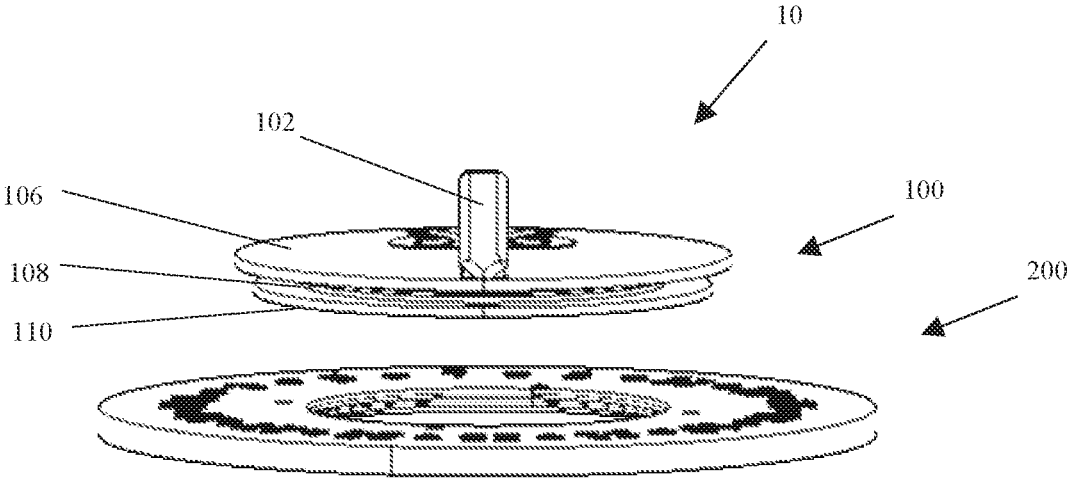
FIG. 2 is a side perspective view of the embodiments of components of the jar lid.

Referring first to FIG. 1, a two-piece jar lid 10 is shown. As shown in the separated view of FIG. 2, the jar lid 10 includes a circular component 100 and an annular component 200. In practice, the circular component 100 can be releasably retained or disposed within the annular component 200 to form the jar lid 10. The jar lid 10 can be secured to a mason jar using a threaded band or ring, as is currently known in the art.

Figure 3:
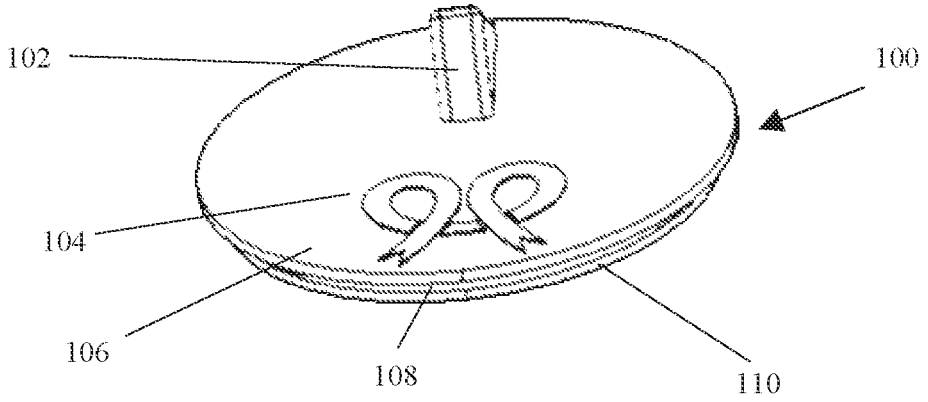
FIG. 3 is a top perspective view of an embodiment of a circular component of the jar lid.
Figure 5:
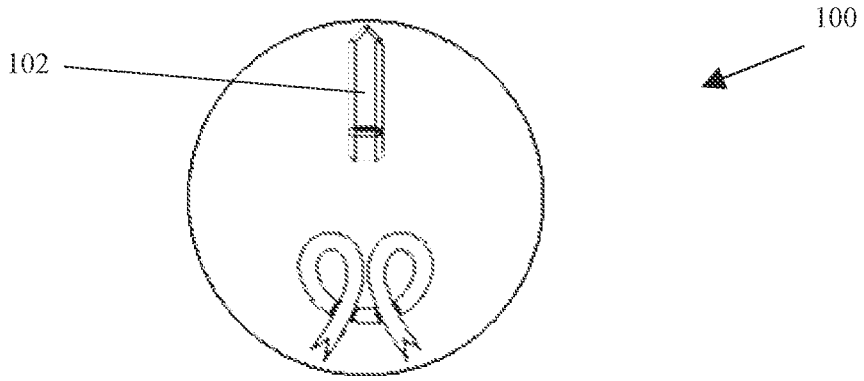
FIG. 5 is a top view of an embodiment of a circular component of the jar lid.

As shown in 2, 3, and FIG. 5, the circular component 100 can include a raised knob 102 disposed on and projecting from the first or upper surface 106. The knob 102 is sufficiently sized to be capable of being grasped by a user to rotate or manipulate the circular component 100 (e.g. to release the circular component 100 from the annular component 200). The knob 102 located on the circular component IOU can also serve as an indicator in conjunction with indicia located on the annular component, as discussed below. In the embodiment shown in FIG. 3, the first surface 106 is substantially planar. When installed onto a mason jar, the first surface 106 will be user-facing and can thus include a branding, graphic or other ornamentation 104 that will be seen by the user when in use.

Figure 7:
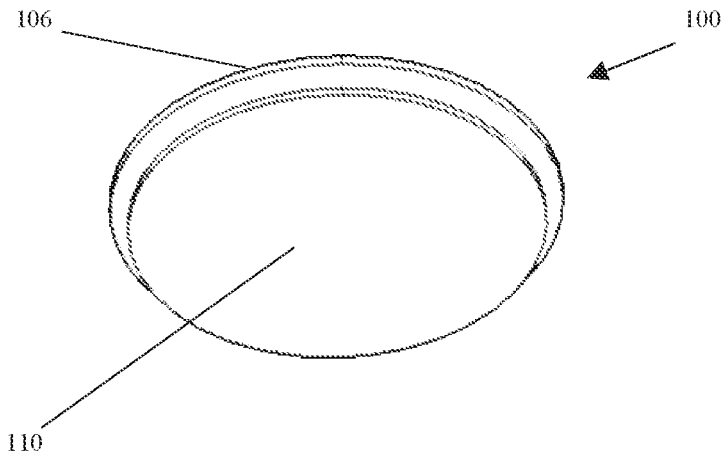
FIG. 7 is a bottom perspective vie of an embodiment of a circular component of the jar lid.

The circular component 100 can also include a second or lower surface 110 opposite from the first or upper surface 106, which can also be substantially planar as shown in FIG. 7 (discussed below). One or more projections and/or grooves 108 can be formed in the circular component 100 between the first surface 106 and second surface 110. In an embodiment, the projections or grooves 108 can be formed on a side surface of the circular component 100. The one or more projections and/or grooves 108 can cooperate with projections and/or grooves disposed on the annular component 200 to facilitate secured but releasable disposition of the circular component 100 within the annular component 200, as discussed in more detail herein.

Figure 4:
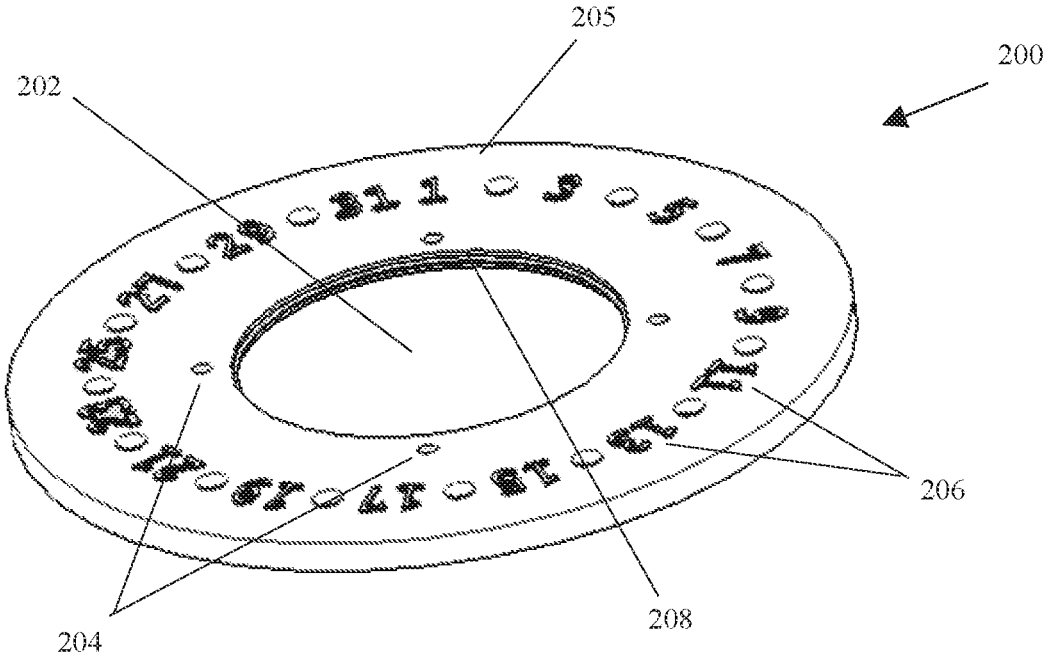
FIG. 4 is a top perspective view of an embodiment of an annular component of the jar lid.
Figure 6:
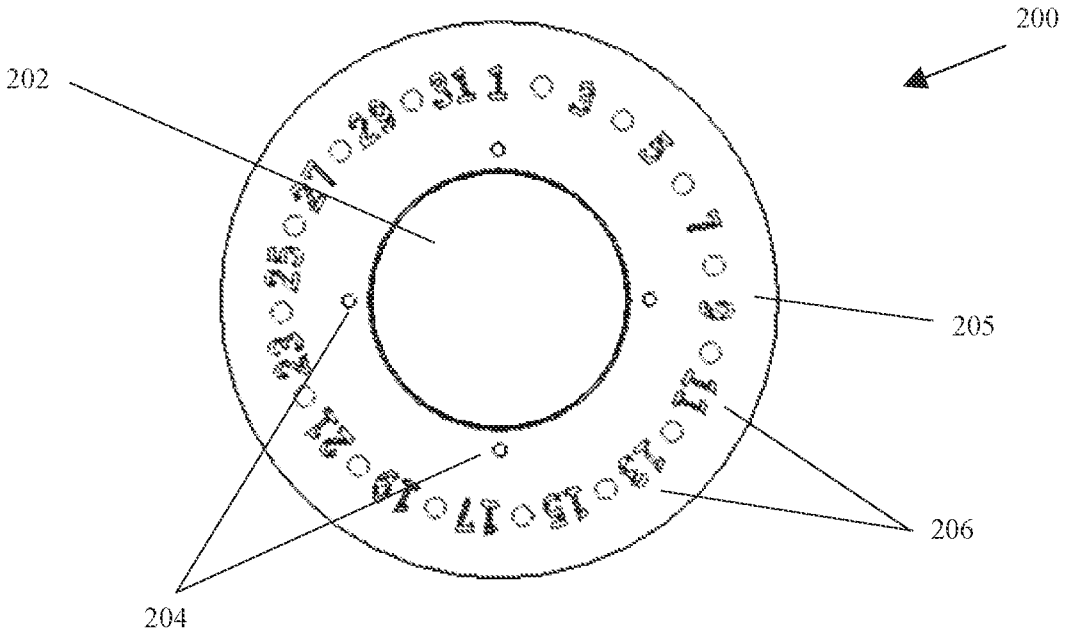
FIG. 6 is a top view of an embodiment of an annular component of the jar lid.

Referring now to FIG. 4 and FIG. 6, the annular component 200 is configured in an annular or ring-like form. The annular component 200 defines an opening 202, with said opening 202 having a circular shape and thus also having a diameter. The annular component 200 includes a first or upper surface 205 and a second or lower surface 210 (shown in FIG. 8). The first surface 205 and/or second surface 210 can be substantially planar. When installed onto a mason jar, the first surface 205 will be user-facing and can thus include one more indicia 206 (e.g. for the purpose described below with reference to FIG. 15). In the embodiment shown in FIG. 4, the indicia 206 represent the 31 days that can occur within a month. In other embodiments, the indicia 206 can instead represent months, years, or jar contents.

This disclosure refers to embodiments having a rotatable circular component 100, with an indicator (e.g. knob 102) being disposed on the circular component 100 and corresponding indicia disposed on the annular component 200. Similarly, an indicator may be disposed on the annular component 200, with indicia disposed on the circular component 100, such that rotation of the circular component still causes alignment of the indicator with the indicia.

During the fermentation process, gases are created and must be vented. Thus, for users that intend to use the jar lid 10 for fermentation processes, the jar lid 10 can include one or more vent holes or other means for venting, to permit unwanted gases to vent while simultaneously preventing air from entering the jar. More specifically, the circular component 100 and/or the annular component 200 can include one or more means for venting. In the embodiment shown in FIG. 4, the annular component 200 can further include one or more venting channels 204. In the embodiment shown in FIG. 4, four venting channels 204 are shown, but the annular component 200 can include more or fewer than four venting channels. While the jar lid 10 typically requires venting channels to permit fermentation, some non-fermentation embodiments of the jar lid 10 can include an annular component 200 with no venting channels. In some embodiments, a venting channel 204 disposed in the annular component 200 can be releasably sealed by the circular component 100 disposed thereon.

Figure 8:
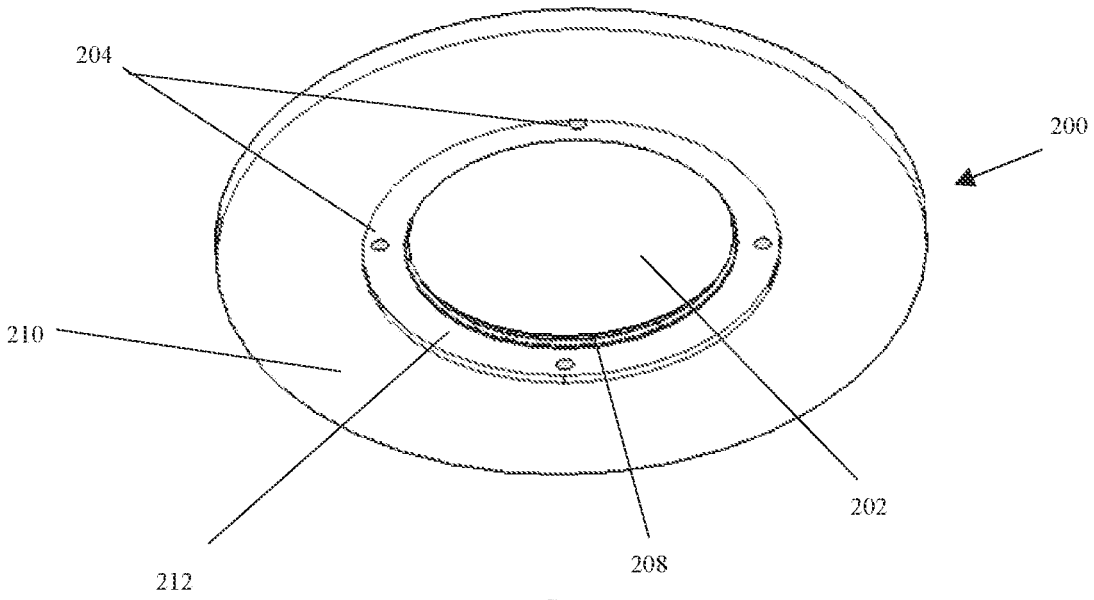
FIG. 8 is a bottom perspective view of an embodiment of an annular component of the jar lid.

Referring again to FIG. 4, the annular component 200 can include one or more projections and/or grooves 208 formed in the annular component 200 between the first surface 205 and the second surface 210 (FIG. 8). In an embodiment, the projections or grooves 208 can be formed on a side surface of the annular component 200. To ensure a snug fit between the circular component 100 and the annular component 200, a projection formed in the annular component 200 can mate with a groove in the circular component 100, or vice versa. Multiple projections and/or grooves can be utilized in this manner.

Referring now to FIG. 7 and FIG. 8, the "underside" or "bottom side" of the circular component 100 and annular component 200 are shown, respectively. As discussed earlier, the circular component 100 can include a first surface 106 and a second surface 110. As shown in FIG. 7, the diameter of the second surface 110 can be smaller than the diameter of the first surface 106, such that the first surface 106 extends radially out from the diameter of the second surface 110. As shown in FIG. 8 (which is drawn to scale in an embodiment) the diameter of the opening 202 can be sized to accommodate the smallest diameter of the circular component 100. As shown, the diameter of the opening 202 is sized to accommodate the diameter around which the projections and grooves 108 project and recede from the circular component 108. With such sizing, the projections and grooves 108 fit snugly and communicate with respective grooves and projections 208 disposed on the annular component 200.

As previously discussed and again shown in FIG. 8, the annular component can have one or more vent holes 204. These venting channels or holes 204. The venting channels 204 can extend from the first surface 205 (FIG. 4 and FIG. 6) to the underside of the annular component generally reflected as second surface 210 and shown in FIG. 8. As shown in FIG. 8, the second surface 210 can have a recessed surface 212 disposed therein. In some embodiments, the venting channels or holes 204 can extend from the first surface 205 and terminate at the recessed surface 212.

Figure 9:
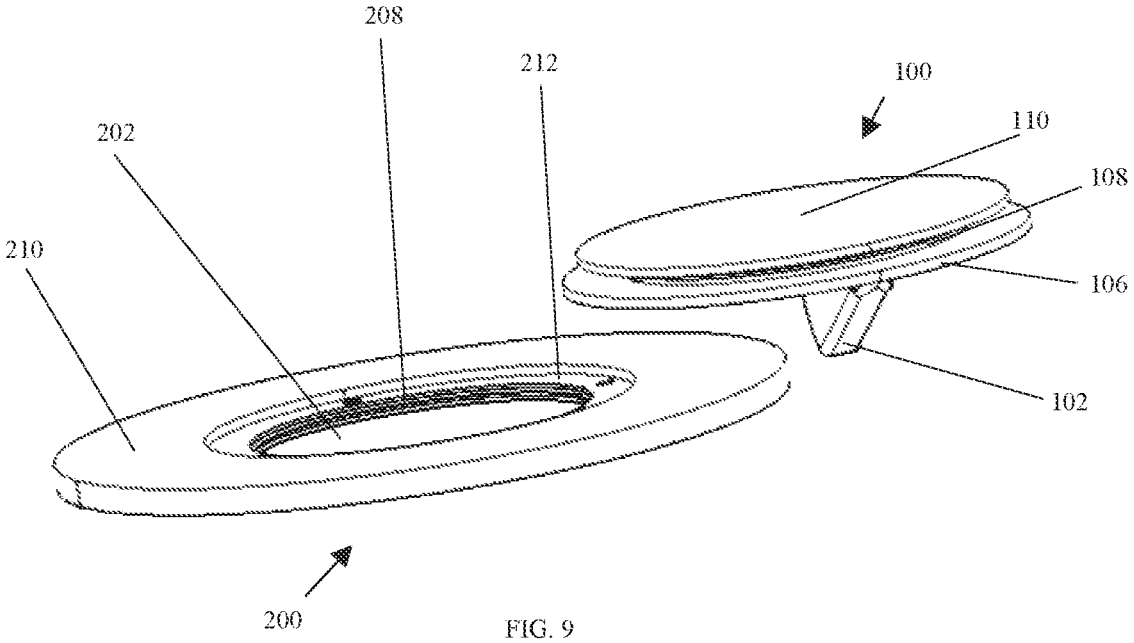
FIG. 9 is a bottom perspective view of embodiments of an annular component and circular component of the jar lid.
Figure 10:
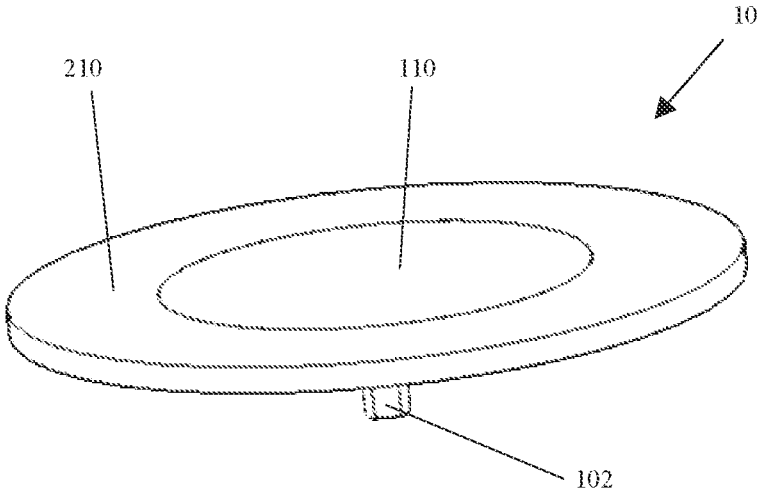
FIG. 10 is a bottom perspective view of an embodiment of the annular component disposed within the circular component to form the jar lid.
Figure 11:
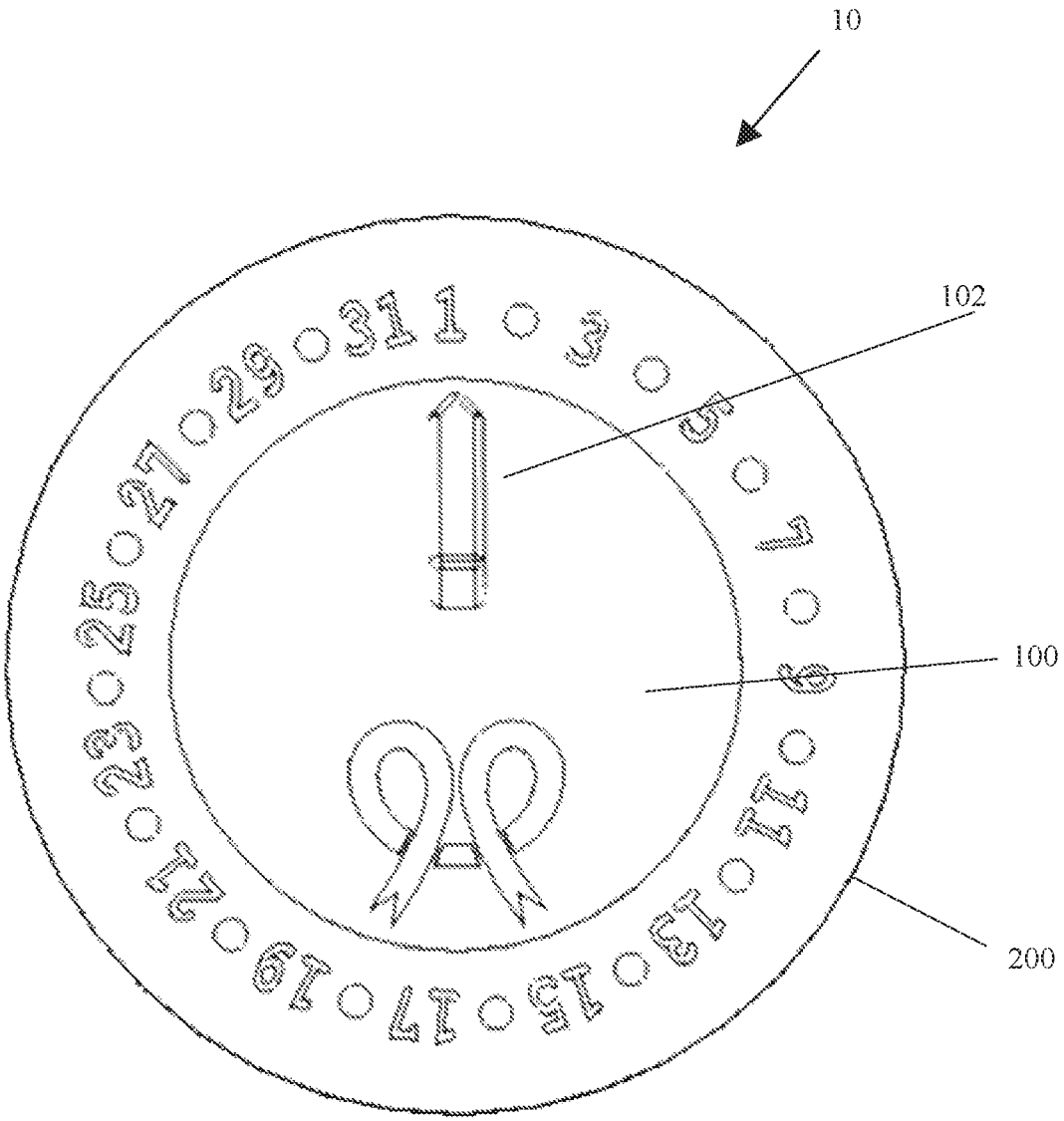
FIG. 11 is a top view of the annular component disposed within the circular component to form the jar lid

FIG. 9 shows an alternate view of the components shown in FIG. 7 and FIG. 8, with the "underside" of the circular component 100 and annular component 200 shown towards the top of the page. From the alternative perspective shown in FIG. 9, the recess 212 within the bottom surface 210 can be better seen, as can the mating relationship between the projections and grooves 108 and 208. FIG. 10 primarily illustrates the "underside" of the jar lid 102 with the circular component 100 seated within the annular component 200. As can be seen, the second surface 110 of the circular component 100 seats flushly adjacent to the second surface 210 of the annular component. FIG. 11 depicts the top view of the combined jar lid 10 shown in FIG. 10.

Figure 12:
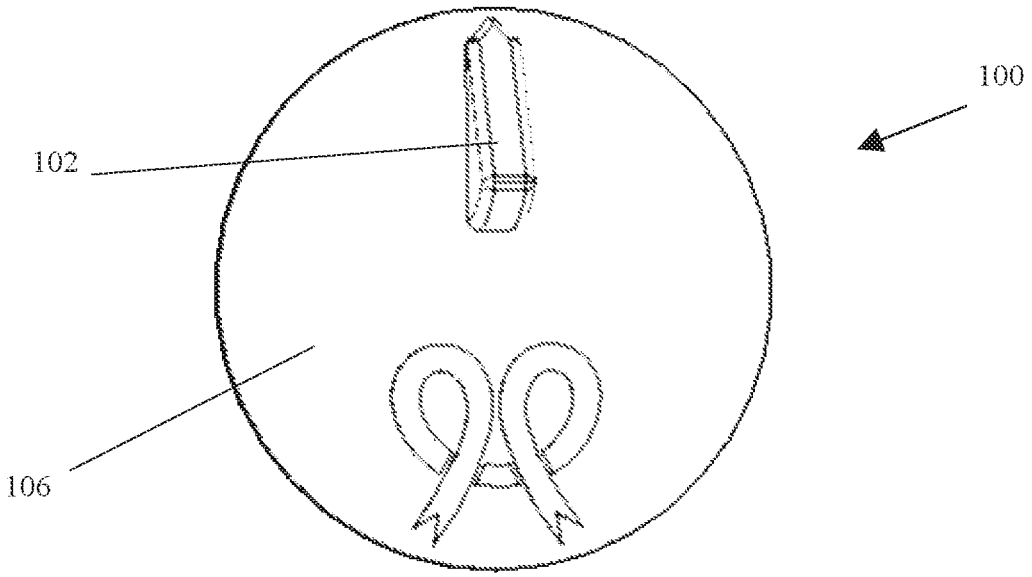
FIG. 12 is a top view of an embodiment of a circular component of the jar lid.
Figure 13:
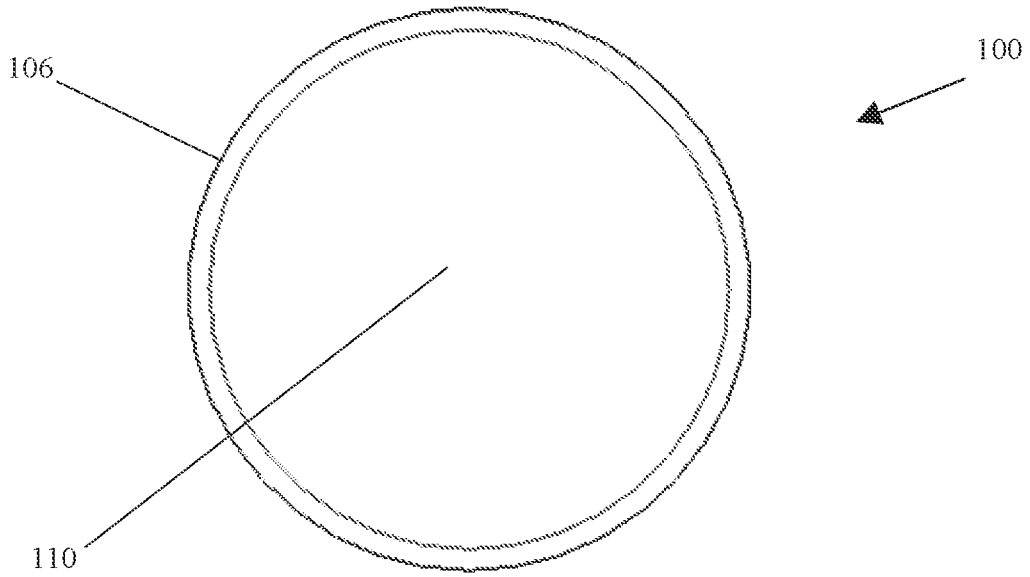
FIG. 13 is a bottom view of an embodiment of a circular component of the jar lid.
Figure 14:
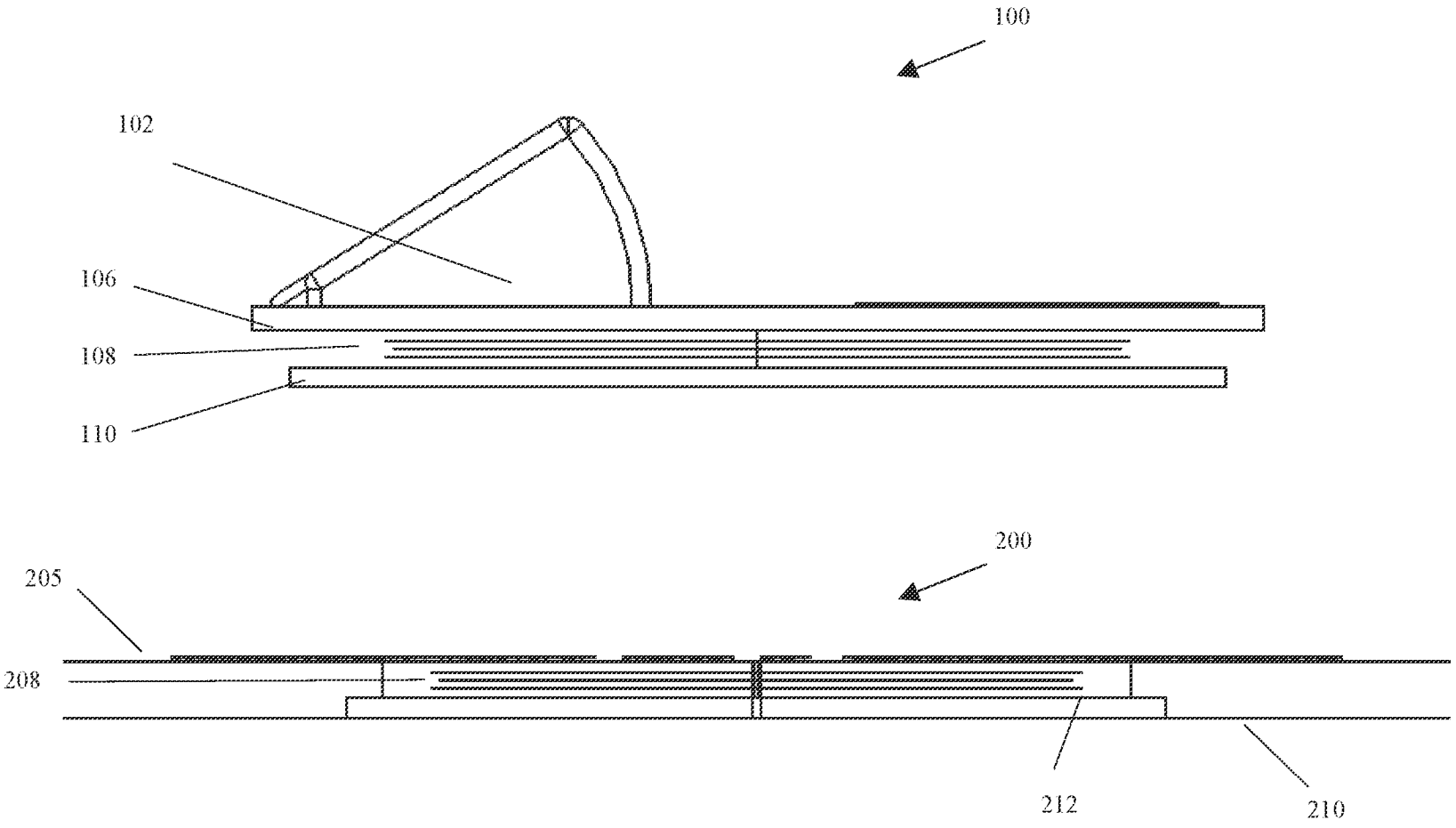
FIG. 14 is a side view of an embodiment of a circular component and an annular component of the jar lid.

FIG. 12 and FIG. 13 show top and bottom views, respectively, of the circular component 100. As can be seen in these figures, the bottom surface 110 has a smaller diameter than the top surface 106. The diameter of the bottom surface 110 fits snugly within the recess 212 (FIG. 8 and FIG. 9), which is appropriately sized to accommodate the same. FIG. 14 depicts cross sectional views of the circular component 100 and the annular component 200, illustrating the location and disposition of the projections and grooves 108 and 208 that interrelate to securely retain the circular component 100 within the annular component 200.

Figure 15:
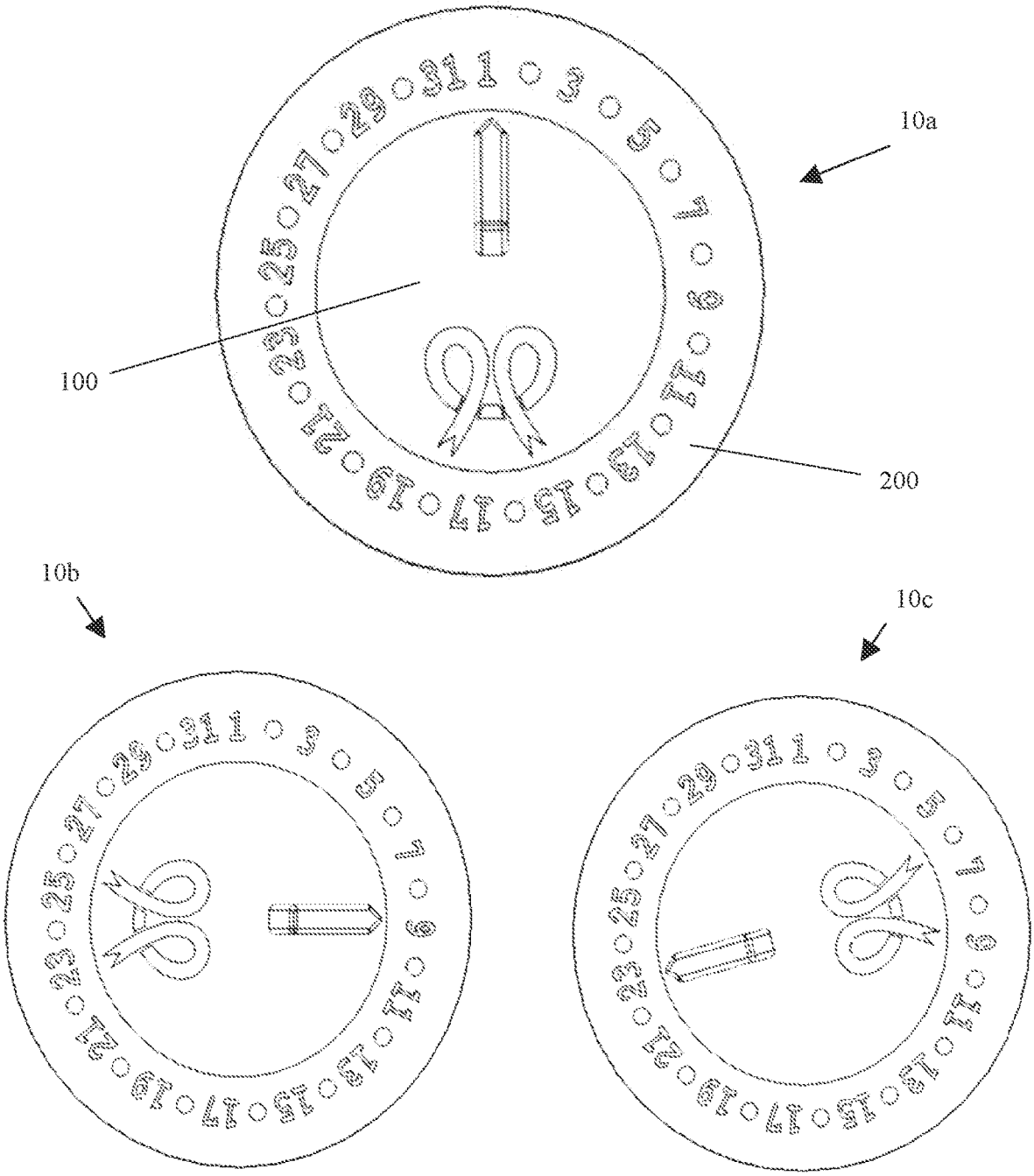
FIG. 15 is a top view of several configurations of the circular component disposed within the annular component to form the jar lid.

FIG. 15 depicts three of many possible configurations 10*a*, 10*b*, and 10*c* of the circular component 100 within the annular component. As seen, the circular component 100 can be rotated about its central axis within the annular component 200. A user can grab the knob 102 to rotate the circular component 100 about the annular component 200. The same knob 102 can include a tapered tip such that it also serves an indicator. For example, as shown in configuration 10*b*, a user who secured the jar lid to a jar on July $9^{th}$ could rotate the indicator 102 to point to the "9" to indicate such a date. Similarly, if the same user wanted to indicate that the jar lid 10 was to be removed two weeks after July $9^{th}$, the user could grab the knob/indicator 102 and rotate the circular component such that the knob/indicator 102 pointed towards the "23". Such a configuration 10*c* would remind the user to check on the contents of the jar two weeks later, on July $23^{rd}$. As can be appreciated, the indicia shown in FIG. 15 can be used in many similar manners. Additionally, different indicia may be shown on the annular component, such as months, years, or recipes, and users can similarly use the knob/indicator 102 to point the indicator towards the indicia of their choice—the two component jar lid 10 permits the same.

Although the embodiment shown in FIG. 15 includes indicia on the annular component 200 and the indicator on the circular component 100, the opposite configuration is also possible—the indicator can be located on the annular component 200 and the indicia can be located on the circular component, such that rotation of the circular component still allows the desired indicia to be aligned with the indicator.

What is claimed is:

1. A jar lid for sealing a mason jar, the jar lid comprising:

a substantially planar annular lid component defining a circular opening therein, the circular opening having an opening diameter; and a substantially planar circular lid component having a central diameter, wherein the substantially planar circular lid component is separate from the annular lid component, but configured to be rotatably disposed within the circular opening of the annular lid component, wherein the combined annular lid component and circular lid component have a combined jar lid diameter and are retained to the mason jar using a threaded annular mason jar ring, and wherein a length of the central diameter is at least one third of a length of the combined jar lid diameter.

2. A jar lid for sealing a mason jar, the jar lid comprising:

an annular lid component defining an opening having an opening diameter, the annular lid component comprising indicia disposed about the opening diameter;

a separate circular lid component having an upper surface and a lower surface, the circular lid component securely and rotatably disposed within the opening diameter of the annular lid component;

a grabbable operating knob disposed on the upper surface of the separate circular lid component, the grabbable operating knob rotatable with the circular lid component and pointable towards one of the indicia.

* * * * *